US006979392B2

(12) United States Patent
Narita et al.

(10) Patent No.: US 6,979,392 B2
(45) Date of Patent: Dec. 27, 2005

(54) METHOD FOR FORMING RE—CR ALLOY FILM OR RE-BASED FILM THROUGH ELECTROPLATING PROCESS

(75) Inventors: Toshio Narita, Hokkaido (JP); Shigenari Hayashi, Hokkaido (JP); Takayuki Yoshioka, Kanagawa (JP); Hiroshi Yakuwa, Kanagawa (JP); Michiaki Souma, Hokkaido (JP)

(73) Assignees: Japan Science and Technology Agency, Kawaguchi (JP); Ebara Corporation, Tokyo (JP); Sapporo Electroplating Industrial, Co., Ltd., Sapporo (JP)

( * ) Notice: Subject to any disclaimer, the term of this patent is extended or adjusted under 35 U.S.C. 154(b) by 0 days.

(21) Appl. No.: 10/501,720

(22) PCT Filed: Jan. 17, 2003

(86) PCT No.: PCT/JP03/00353

§ 371 (c)(1),
(2), (4) Date: Feb. 16, 2005

(87) PCT Pub. No.: WO03/062500

PCT Pub. Date: Jul. 31, 2003

(65) Prior Publication Data

US 2005/0126922 A1 Jun. 16, 2005

(30) Foreign Application Priority Data

Jan. 18, 2002 (JP) ..... 2002-010693
Jan. 18, 2002 (JP) ..... 2002-010723
Jan. 18, 2002 (JP) ..... 2002-010764
Jan. 18, 2002 (JP) ..... 2002-010787

(51) Int. Cl.[7] ..... C25D 3/56
(52) U.S. Cl. ..... 205/238; 205/243
(58) Field of Search ..... 205/238, 243

(56) References Cited

U.S. PATENT DOCUMENTS 3,285,839 A 11/1966 Camp
3,668,083 A 6/1972 Meyer et al.

(Continued)

FOREIGN PATENT DOCUMENTS

JP 54-93453 7/1979

OTHER PUBLICATIONS

Patent Abstracts of Japan, Publication No. 09-302496, dated Nov. 25, 1997. Cited in the international search report.

(Continued)

*Primary Examiner*—Roy King
*Assistant Examiner*—William T. Leader
(74) *Attorney, Agent, or Firm*—Westerman, Hattori, Daniels & Adrian, LLP

(57) ABSTRACT

Disclosed is a method for forming: a Re—Cr alloy film consisting of Re in the range of greater than 0 (zero) to less than 98% by atomic composition, and the remainder being Cr except inevitable impurities; a Re-based film consisting of 98% or more, by atomic composition, of Re, with the remainder being Cr and inevitable impurities; or a Re—Cr—Ni alloy film consisting of Re in the range of 50 to less than 98% by atomic composition, Cr in the range of 2 to less than 45% by atomic composition, and the remainder being Ni except inevitable impurities. The method comprises performing an electroplating process using an electroplating bath containing an aqueous solution which includes a perrhenate ion and a chromium (III) ion. The present invention allows a Re—Cr alloy, Re-based or Re—Cr—Ni alloy film usable as a corrosion-resistant alloy coating for a high-temperature component or the like to be formed through an electroplating process using an aqueous solution, so as to provide heat/corrosion resistances to the component, even if it has a complicated shape, in a simplified manner at a low cost.

14 Claims, 4 Drawing Sheets

U.S. PATENT DOCUMENTS 4,477,318 A * 10/1984 Tomaszewski ..... 205/101
4,778,573 A 10/1988 Tabe et al.

OTHER PUBLICATIONS

Hisanori Fukushima, Ammonia-sei Kuensan' en Yokukara no Re—Ni Gokin Denchaku, Kinzoku Hyomen Shori, vol. 26, No. 5, pp. 198-203, 1985. Cited in the international search report.

Patent Abstracts of Japan, Publication No. 09-302495, dated Nov. 25, 1997. Cited in the specification.

* cited by examiner

METHOD FOR FORMING RE—CR ALLOY FILM OR RE-BASED FILM THROUGH ELECTROPLATING PROCESS

TECHNICAL FIELD

The present invention relates to a method for forming a Re—Cr alloy or Re-based film usable as a corrosion-resistant coating for high-temperature components or the like.

BACKGROUND ART

A Ni-based superalloy substrate for use in a blade for jet engines, gas turbines or the like is strictly required to have high oxidation resistance and corrosion resistance. Such required high-temperature oxidation resistance has been obtained through a surface diffusion treatment, for example, by coating a substrate surface with an $Al_2O_3$ film. For covering the insufficient performance of this treatment, there has also been developed a technique for forming a diffusion barrier layer of Pt or the like on a substrate. Rhenium (Re) can be used as the diffusion barrier layer to provide enhanced high-temperature corrosion resistance. Re excellent in thermal shock resistance is also used as high-temperature members or components of various combustors, such as a rocket-engine combustor, or high-temperature nozzles. Heretofore, there have been known the following processes for forming a Re-based film or a Re alloy film.

(1) Sputtering Process or Physical Deposition Process

A physical deposition process allows a film thickness and/or composition to be readily controlled. On the other hand, it involves problems, such as, (i) many restrictions on the size and shape of a substrate, (ii) the need for a large-scaled apparatus and complicated operations and (iii) a relatively large number of defects or cracks in an obtained film.

(2) Thermal Spraying Process

A thermal spraying process involves problems, such as, (i) a relatively large number of defects in an obtained film, (ii) lack of compatibility to the formation of thin films (10 $\mu$m or less) and (iii) poor process yield and low economical efficiency.

(3) Re-Alloy Electroplating Process

There have been known a Ni—Cr—Re alloy film having a Re content of up to 50 weight % (this percentage becomes lower when converted into atomic composition ratio), a Ni—Co—Re alloy film (see, for example, Japanese Patent Laid-Open Publication Nos. 09-302495 and 09-302496), and a Re—Ni alloy film for electric contacts, which has a Re content of up to 85 weight % (63 atomic %) (see, for example, Japanese Patent Laid-Open Publication No. 54-93453). In all of the above plated films, the content of Re is in a low level.

DISCLOSURE OF INVENTION

In view of the above circumstances, it is therefore an object of the present invention to provide a method capable of forming a Re—Cr alloy or Re-based film on a surface having a complicated shape, which cannot be achieved by a sputtering process or physical deposition process.

It is another object of the present invention to provide a method capable of forming a Re—Cr alloy or Re-base film at a thin thickness, which cannot be achieved by a thermal spraying process.

It is still another object of the present invention to provide a method capable of forming a Re—Cr alloy or Re-based film through an electroplating process at a low cost in a simplified manner as compared to the physical deposition process and the thermal spraying process.

In order to achieve the above objects, the inventors first developed a Re—Cr alloy film electroplating process in which the respective concentrations of a perrhenate ion and a chromium (III) ion in a plating bath are adjusted, and one or more effective ions are added into the plating bath, so as to freely control the composition of a plated film.

Specifically, according to a first aspect of the present invention, there is provided a method for forming a Re—Cr alloy film, comprising performing an electroplating process using a plating bath which contains an aqueous solution including a perrhenate ion in a concentration of 0.0001 to less than 2.0 mol/L, and a chromium (III) ion in a concentration of greater than 0.001 to 10.0 mol/L. In this method, the molar ratio of the perrhenate ion to the chromium (III) ion in the plating bath is in the range of greater than 0.001 to less than 0.1, and the plating bath has a pH of 0 to 8 and a temperature of 10 to 80° C. According to this method, the composition of the Re—Cr alloy film can be freely controlled to have Re in the range of greater than 0 (zero) to less than 98% by atomic composition.

In the method set forth in the first aspect of the present invention, if the concentration of perrhenate ion is less than 0.0001 mol/L, no Re will be contained in a resulting plated film. Further, if the concentration of perrhenate ion is 2.0 mol/L or more, no Cr will be contained in a resulting plated film. If the concentration of chromium (III) ion is 0.001 mol/L or less, no Cr will be contained in a resulting plated film. Further, the use of a concentration of chromium (III) ion greater than 10.0 mol/L causes creation of an insoluble substance in the bath to result in deteriorated flowability of the aqueous solution. If the molar ratio of the perrhenate ion to the chromium (III) ion in the plating bath is 0.1 or more, almost no Cr will be contained in a resulting plated film. Further, if the molar ratio is 0.001 or less, substantially no Re will be contained in a resulting plated film. For these reasons, in the method set forth in the first aspect of the present invention, the concentration of the perrhenate ion is defined in the range of 0.0001 to less than 2.0 mol/L; the concentration of the chromium (III) ion is defined in the range of greater than 0.001 to 10.0 mol/L; and the molar ratio of the perrhenate ion to the chromium (III) ion is defined in the range of greater than 0.001 to less than 0.1.

The inventors secondly found that a specific type of alkali metal ion or alkali earth metal ion can be added into the above plating bath in an appropriate concentration to control the activity of the perrhenate ion. Based on this knowledge, the inventors developed a Re—Cr alloy film electroplating process capable of freely controlling the composition of a plated film.

Specifically, according to a second aspect of the present invention, there is provides a method for forming a Re—Cr alloy film, comprising performing an electroplating process using a plating bath which contains an aqueous solution including a perrhenate ion in a concentration of 0.0001 to less than 2.0 mol/L, a chromium (III) ion in a concentration of greater than 0.001 to 10.0 mol/L, and at least one ion selected from the group consisting of potassium, rubidium, cesium, calcium, strontium and barium ions, in a concentration of 0.001 to 10.0 mol/L. In this method, the plating bath has a pH of 0 to 8, and a temperature of 10 to 80° C. According to this method, the composition of the Re—Cr alloy film can be freely controlled to have Re in the range of greater than 0 (zero) to less than 98% by atomic composition.

In the method set forth in the second aspect of the present invention, if the concentration of perrhenate ion is less than 0.0001 mol/L, no Re will be contained in a resulting plated film. Further, if the concentration of perrhenate ion is 2.0 mol/L or more, no Cr will be contained in a resulting plated film. If the concentration of chromium (III) ion is 0.001 mol/L or less, no Cr will be contained in a resulting plated film. Further, the use of a concentration of chromium (III) ion greater than 10.0 mol/L causes creation of an insoluble substance in the bath to result in deteriorated flowability of the aqueous solution.

As to the at least one ion selected from the group consisting of potassium, rubidium, cesium, calcium, strontium and barium ions, the use of a concentration of the ion less than 0.001 causes deterioration in the effect of suppressing the activity of $ReO_4^-$. Further, even if the ion is added in a concentration of greater than 10.0 mol/L, this effect will not be improved any more. For these reasons, in the method set forth in the second aspect of the present invention, the concentration of the perrhenate ion is defined in the range of 0.0001 to less than 2.0 mol/L; the concentration of the chromium (III) ion is defined in the range of greater than 0.001 to 10.0 mol/L; and the concentration of the at least one ion selected from the group consisting of potassium, rubidium, cesium, calcium, strontium and barium ions, is defined in the range of 0.001 to 10.0 mol/L.

In the methods set forth in the first and second aspects of the present invention, the alloy film to be formed may have a composition consisting of Re in the range of greater than zero to less than 98% by atomic composition, and the remainder being Cr except inevitable impurities. This alloy film can have desired functions depending on the type of substrate and an intended purpose.

The inventors thirdly found that, while a plating bath containing only a transition metal ion and a perrhenate ion provides almost no electrolytic deposition of Re, a plating bath with a perrhenate ion and a $Cr^{3+}$ ion coexisting therein allows only Re to be electrolytically deposited with a purity of 98 atomic % or more, almost without electrolytic deposition of Cr, by controlling the concentration ratio between the perrhenate ion and other metal ions and the pH of the plating bath.

Specifically, according to a third aspect of the present invention, there is provides a method for forming a Re-based film, comprising performing an electroplating process using a plating bath which contains an aqueous solution including a perrhenate ion in a concentration of 0.001 to 2.0 mol/L, and a chromium (III) ion in a concentration of 0.01 to 10.0 mol/L. In this method, the molar ratio of the perrhenate ion to the chromium (III) ion in the plating bath is 0.1 or more. In this method, the plating bath has a pH of 0 to 8, and a temperature of 10 to 80° C. According to this method, Re can be electrolytically deposited with a purity of 98 atomic % or more.

In the method set forth in the third aspect of the present invention, the use of a concentration of perrhenate ion less than 0.001 mol/L results in an insufficient Re content in a resulting plated film, and the use of a concentration of perrhenate ion greater than 2.0 mol/L causes creation of an insoluble substance in the bath. The use of a concentration of $Cr^{3+}$ ion less than 0.01 mol/L causes significant deterioration in electrolytic deposition efficiency of Re, and the use of a concentration of $Cr^{3+}$ ion greater than 10.0 mol/L causes creation of an insoluble substance in the bath. For these reasons, in the method set forth in the third aspect of the present invention, the concentration of the perrhenate ion is defined in the range of 0.001 to 2.0 mol/L, and the concentration of the $Cr^{3+}$ ion is defined in the range of 0.01 to 10.0 mol/L.

In the method set forth in the third aspect of the present invention, the film to be formed has a composition consisting of greater than 98% or more, by atomic composition, of Re, with the remainder being Cr and inevitable impurities. This alloy film can have desired functions depending on the type of substrate and an intended purpose.

In the methods set forth in the first to third aspects of the present invention, the plating bath may contain an organic acid in a concentration of 0.1 to 15.0 equivalents to the concentration of all of the metal ions. This can facilitate the control of the composition of the film. In addition, the type and concentration of the organic acid can be specified to control the film composition with a higher degree of accuracy. In this case, if the organic acid is contained in the plating bath in a concentration of less than 0.1 equivalents to the concentration of all of the metal ions, an intended effect cannot be sufficiently obtained. Further, the use of a concentration of organic acid greater than 15 equivalents causes creation of an insoluble substance in the bath to result in deteriorated flowability of the aqueous solution. Therefore, the concentration of the organic acid is preferably set in the range of 0.1 to 15.0 equivalents.

The inventors fourthly developed an electroplating technique in which the respective concentrations of a perrhenate ion and a chromium (III) ion in a plating bath are controlled, and one or more effective chemical species are added into the plating bath, so as to form a Re—Cr—Ni alloy film, or an alloy film formed by further adding Ni into the Re—Cu alloy, which has a composition effective to a heat/corrosion-resistant coating.

Specifically, according to a fourth aspect of the present invention, there is provides a method for forming a Re—Cr—Ni alloy film, comprising performing an electroplating process using a plating bath which contains an aqueous solution including a perrhenate ion in a concentration of 0.01 to 2.0 mol/L, a chromium (III) ion in a concentration of greater than 0.8 to 4.0 mol/L, and a nickel (II) ion in a concentration of 0.0001 to 0.2 mol/L. In this method, the plating bath has a pH of 0 to 8, and a temperature of 10 to 80° C. According to this method, a Re—Cr—Ni alloy film capable of serving as a heat/corrosion-resistant alloy coating can be electrolytically deposited or plated.

In the method set forth in the fourth aspect of the present invention, if the concentration of perrhenate ion is less than 0.001 mol/L, no Re will be contained in a resulting plated film. Further, if the concentration of perrhenate ion is greater than 2.0 mol/L, no Cr will be contained in a resulting plated film. If the concentration of chromium (III) ion is 0.8 mol/L or less, no Cr will be contained in a resulting plated film. Further, the use of a concentration of chromium (III) ion greater than 4.0 mol/L causes creation of an insoluble substance in the bath to result in deteriorated flowability of the aqueous solution. If the concentration of nickel (II) ion is less than 0.0001 mol/L, no Ni will be contained in a resulting plated film. Further, if the concentration of nickel (II) ion is greater than 0.2 mol/L, no Cr will be contained in a resulting plated film. For these reasons, in the method set forth in the fourth aspect of the present invention, the concentration of the perrhenate ion is defined in the range of 0.001 to 2.0 mol/L; the concentration of the chromium (III) ion is defined in the range of greater than 0.8 to 4.0 mol/L;

and the concentration of the nickel (II) ion is defined in the range of 0.0001 to 0.2 mol/L.

In the method set forth in the fourth aspect of the present invention, the molar ratio of the chromium (III) ion to the nickel (II) ion in the plating bath may be 2 or more. If the molar ratio is less than 2, the content of Cr will be likely to be insufficient.

In the method set forth in the fourth aspect of the present invention, the alloy film to be formed may have a composition consisting of Re in the range of 50 to less than 98% by atomic composition, Cr in range of 2 to less than 45% by atomic composition, and the remainder being Ni except inevitable impurities. This alloy film can have desired functions depending on the type of substrate and an intended purpose.

In the method set forth in the fourth aspect of the present invention, the plating bath may contain an organic acid and/or a boric acid, in a concentration of 0.1 to 5.0 equivalents to the concentration of all of said metal ions. This allows the composition of the film to be accurately controlled. In addition, the type and concentration of the organic acid can be specified to control the film composition with a higher degree of accuracy. In this case, if the organic acid is contained in the plating bath in a concentration of less than 0.1 equivalents to the concentration of all of the metal ions, an intended effect cannot be sufficiently obtained. Further, the use of a concentration of organic acid greater than 15 equivalents causes creation of an insoluble substance in the bath to result in deteriorated flowability of the aqueous solution. Therefore, the concentration of the organic acid is preferably set in the range of 0.1 to 15.0 equivalents.

In the methods set forth in the first to fourth aspects of the present invention, when the organic acid is added to the electroplating bath, it is preferably selected from the group consisting of hydroxycarboxylic acid, carboxylic acid and amino acid. The hydroxycarboxylic acid may be at least one selected from the group consisting of lactic acid, hydroxybutyric acid, glycolic acid, mandelic acid, malic acid, tartaric acid, glyconic acid and citric acid, and their soluble salts. The carboxylic acid may be at least one selected from the group consisting of formic acid, propionic acid, acetic acid, oxalic acid, acrylic acid, malonic acid and ethylenediamine tetraacetic acid, and their soluble salts. The amino acid may be at least one selected from the group consisting of glycine, alanine, proline, valine, leucine, isoleucine, methionine, serine, cysteine, asparagine, glutamine and tyrosine.

In the methods set forth in the first to fourth aspects of the present invention, the electroplating bath has a pH of 0 to 8. This provides a high covering power and a plated film having a homogeneous composition. The use of a pH less than 0 (zero) causes deterioration in covering cover, and the use of a pH greater than 8 causes deteriorated flowability due to creation of a large amount of insoluble substance. Further, the electroplating bath has a plating temperature of 10 to 80° C. The use of a plating temperature less than 10° C. causes significant deterioration in electrolytic deposition efficiency, and the use of a plating temperature greater than 80° C. causes deterioration in covering power. Preferably, the bath pH is set in the range of 2 to 5, and the plating temperature is set in the range of 40 to 60° C.

In the methods set forth in the first to fourth aspects of the present invention, the plating bath may contain an ammonium ion in a concentration of 0.0001 to 5.0 mol/L, and/or a boric acid in a concentration of 0.0001 to 5.0 mol/L. The addition of these substances provides stability in the plating bath to allow the film to be formed with a homogeneous thickness. The use of a concentration of ammonium ion or boric acid less than 0.0001 mol/L causes spots in a plated film, and the use of a concentration of ammonium ion or boric acid grater than 5.0 mol/L causes creation of an insoluble substance to result in deteriorated flowability of the aqueous solution. Therefore, the concentration of the ammonium ion and/or boric acid is preferably set in the range of 0.0001 to 5.0 mol/L.

In the methods set forth in the first to fourth aspects of the present invention, the plating bath may contain a bromine ion in a concentration of 0.0001 to 5.0 mol/L. This prevent the generation of harmful chlorine gas. This effect cannot be obtained by a concentration of bromine ion less than 0.0001 mol/L, and the use of a concentration of bromine ion greater than 5.0 mol/L causes the generation of gas containing Br as a primary component. Therefore, the concentration of the bromine ion is preferably set in the range of 0.0001 to 5.0 mol/L.

In the methods set forth in the first to fourth aspects of the present invention, the plating bath may contain a sulfate ion in a concentration of 0.0001 to 5.0 mol/L, a chloride ion in a concentration of 0.0001 to 5.0 mol/L, a lithium ion in a concentration of 0.0001 to 5.0 mol/L, a sodium ion in a concentration of 0.0001 to 5.0 mol/L, and/or a potassium ion in a concentration of 0.0001 to 5.0 mol/L. The addition of these substances can prevent the lowering of a liquid-junction potential, and makes it possible to achieve enhanced covering power and stable film composition. If the concentration of each of the ions is less than 0.0001 mol/L, these effects cannot be sufficiently obtained. Further, if the concentration of each of the ions is greater than 5.0 mol/L, the aqueous solution cannot have enhanced flowability due to creation of an insoluble substance. Therefore, it is preferable to set the concentration of each of the ions in the range of 0.0001 to 5.0 mol/L.

BEST MODE FOR CARRYING OUT THE INVENTION

INVENTIVE EXAMPLE 1

A copper plate was subjected to degreasing/cleaning, and used as a substrate. A solution was prepared using chromium chloride to have a $Cr^{3+}$ ion in a concentration of 1.0 mol/L and a $ReO_4^-$ ion in a concentration of 0.005 mol/L. In addition to the $ReO_4^-$ ion and $Cr^{3+}$ ion, 1.5 mol/L of acetic acid, 0.5 mol/L of ammonium chloride and 0.5 mol/L of potassium bromide were added to the solution to prepare a plating bath. The pH of the plating bath was adjusted at 4 using sulfuric acid and sodium hydrate. Then, an electroplating process was performed under a plating bath temperature of 35° C. and a current density of 100 mA/cm$^2$.

INVENTIVE EXAMPLE 2

Except that the concentration of the $ReO_4^-$ was set at 0.01 mol/L, an electroplating process was performed under the same conditions as those in Inventive Example 1.

INVENTIVE EXAMPLE 3

Except that the concentration of the $ReO_4^-$ was set at 0.05 mol/L, an electroplating process was performed under the same conditions as those in Inventive Example 1.

INVENTIVE EXAMPLE 4

Except that the concentration of the $ReO_4^-$ was set at 0.1 mol/L, an electroplating process was performed under the same conditions as those in Inventive Example 1.

INVENTIVE EXAMPLE 5

Except that the concentration of the $ReO_4^-$ was set at 1.0 mol/L, an electroplating process was performed under the same conditions as those in Inventive Example 1.

COMPARATIVE EXAMPLE 1

Except that the concentration of the $ReO_4^-$ was set at 0.001 mol/L, an electroplating process was performed under the same conditions as those in Inventive Example 1.

Figure 1:
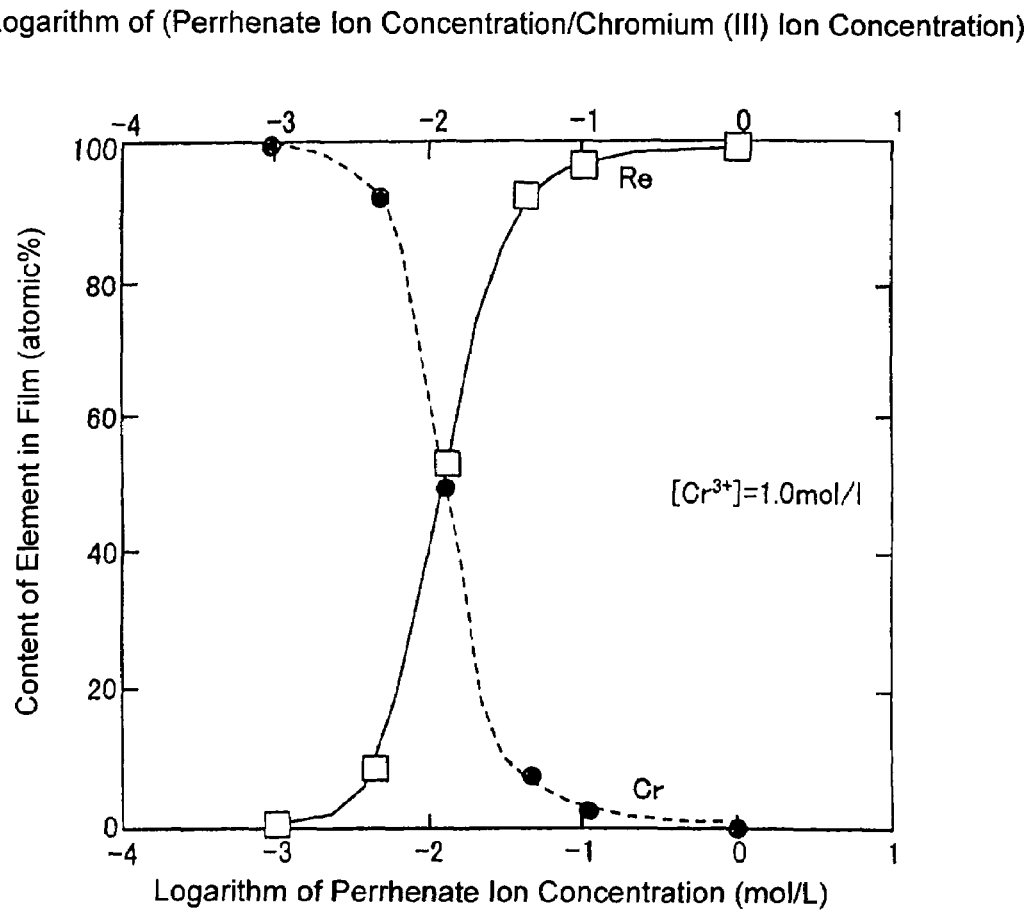
FIG. 1 is a graph showing the relationship between the composition of a plated film and each of the molar concentration of $ReO_4^-$ and the molar concentration ratio of $ReO_4^-/Cr^{3+}$ in a plating bath in each of Inventive Examples 1 to 5 and Comparative Example 1.

FIG. 1 shows the relationship between the composition of a plated film and each of the molar concentration of $ReO_4^-$ and the molar concentration ratio of $ReO_4^-/Cr^{3+}$ in the plating bath in each of Inventive Examples 1 to 5 and Comparative Example 1. As seen in FIG. 1, the plated film obtained from Comparative Example 1 using the bath containing $ReO_4^-$ in a concentration of 0.001 mol/L has a composition consisting of 100 atomic % of Cr. By contrast, the plated film obtained from Inventive Example 1 using the bath containing $ReO_4^-$ in a concentration of 0.05 mol/L has a composition comprising about 10 atomic % of Re and about 90 atomic % of Cr. As shown in FIG. 1, the Re content in the film is increased as the concentration of $ReO_4^-$ ion is increased, and the plated film obtained from Inventive Example 4 using the bath containing $ReO_4^-$ in a concentration of 0.1 mol/L has a composition comprising 98 atomic % of Re and 2 atomic % of Cr.

INVENTIVE EXAMPLE 6

A solution containing $Cr^{3+}$ in a concentration of 0.4 mol/L and $ReO_4^-$ in a concentration of 0.005 mol/L was added with 1.0 mol/L of formic acid, 1.0 mol/L of ammonium chloride, 0.1 mol/L of potassium bromide and 0.8 mol/L of boric acid, to prepare a plating bath. The pH of the plating bath was adjusted at 3 using sulfuric acid and sodium hydrate. Then, an electroplating process was performed under a room temperature. Other conditions were the same as those in Inventive Example 1. After the electroplating process, an alloy film having 90 atomic % of Re and 10 atomic % of Cr was deposited on the surface of the substrate or electrode.

INVENTIVE EXAMPLE 7

A solution containing $Cr^{3+}$ in a concentration of 0.4 mol/L and $ReO_4^-$ in a concentration of 0.0075 mol/L was added with 1.0 mol/L of formic acid, 1.0 mol/L of ammonium chloride, 0.1 mol/L of potassium bromide and 0.8 mol/L of boric acid, to prepare a plating bath. The pH of the plating bath was adjusted at 3 using sulfuric acid and sodium hydrate. Then, an electroplating process was performed under a room temperature. Other conditions were the same as those in Inventive Example 1. After the electroplating process, an alloy film having 90 atomic % of Re and 10 atomic % of Cr was deposited on the surface of the substrate or electrode.

INVENTIVE EXAMPLE 8

A solution containing $Cr^{3+}$ in a concentration of 0.4 mol/L and $ReO_4^-$ in a concentration of 0.01 mol/L was added with 1.0 mol/L of formic acid, 1.0 mol/L of ammonium chloride, 0.1 mol/L of potassium bromide and 0.8 mol/L of boric acid, to prepare a plating bath. The pH of the plating bath was adjusted at 3 using sulfuric acid and sodium hydrate. Then, an electroplating process was performed under a room temperature. Other conditions were the same as those in Inventive Example 1. After the electroplating process, an alloy film having 93 atomic % of Re and 7 atomic % of Cr was deposited on the surface of the substrate or electrode.

INVENTIVE EXAMPLE 9

A copper plate was subjected to degreasing/cleaning, and used as a substrate. A solution was prepared using chromium chloride to have a $Cr^{3+}$ ion in a concentration of 0.1 mol/L and a $ReO_4^-$ ion in a concentration of 0.01 mol/L. In addition to the $ReO_4^-$ ion and $Cr^{3+}$ ion, 1.5 mol/L of acetic acid, 0.5 mol/L of ammonium chloride and 0.5 mol/L of potassium bromide were added to the solution to prepare a plating bath. The pH of the plating bath was adjusted at 4 using sulfuric acid and sodium hydrate. Then, an electroplating process was performed under a plating bath temperature of 35° C. and a current density of 100 mA/cm$^2$.

INVENTIVE EXAMPLE 10

Except that the concentration of the $ReO_4^-$ was set at 0.1 mol/L, an electroplating process was performed under the same conditions as those in Inventive Example 9.

INVENTIVE EXAMPLE 11

Except that the concentration of the $ReO_4^-$ was set at 0.0001 mol/L, an electroplating process was performed under the same conditions as those in Inventive Example 9.

INVENTIVE EXAMPLE 12

Except that the concentration of the $ReO_4^-$ was set at 0.005 mol/L, an electroplating process was performed under the same conditions as those in Inventive Example 9.

Figure 2:
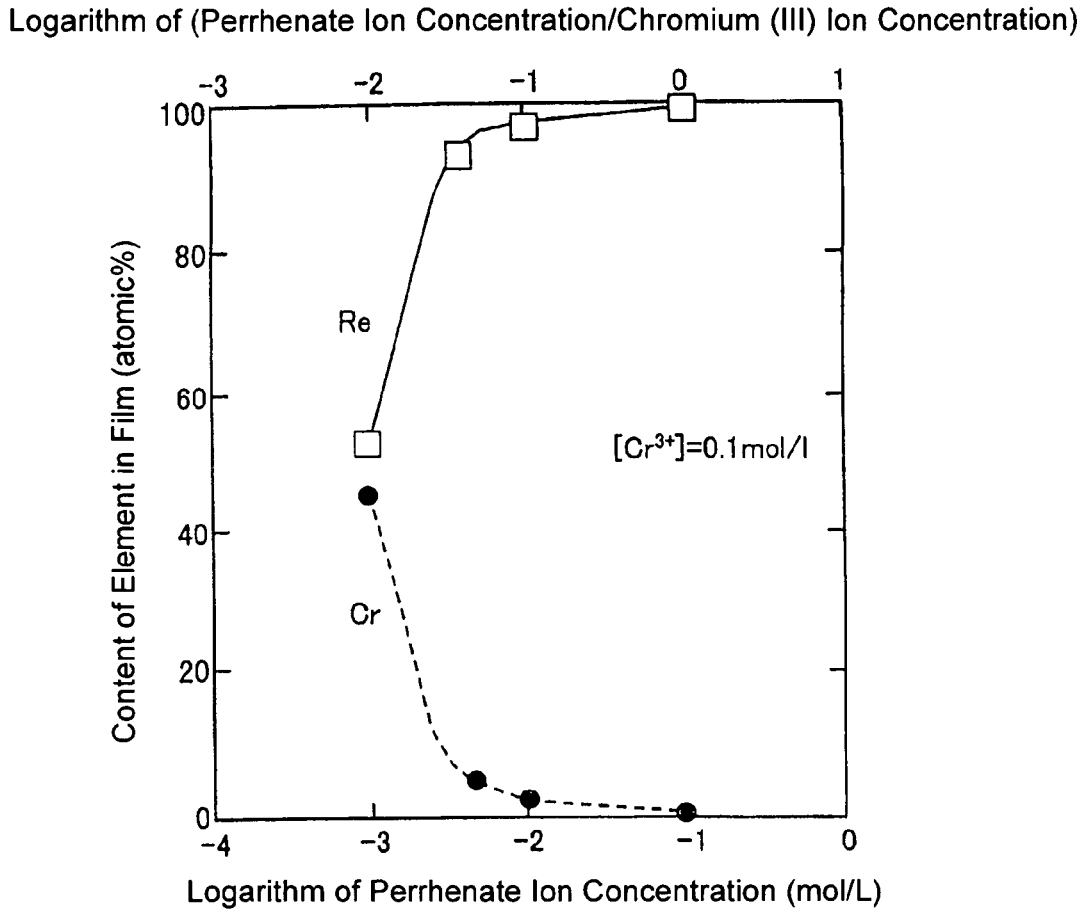
FIG. 2 is a graph showing the relationship between the composition of a plated film and each of the molar concentration of $ReO_4^-$ and the molar concentration ratio of $ReO_4^-/Cr^{3+}$ in a plating bath in each of Inventive Examples 9 to 12.

FIG. 2 shows the relationship between the composition of a plated film and each of the molar concentration of $ReO_4^-$ and the molar concentration ratio of $ReO_4^-/Cr^{3+}$ in the plating bath in each of Inventive Examples 9 to 12. As seen in FIG. 2, in the plating bath containing $Cr^{3+}$ in a concentration of 0.1 mol/L, the plated film obtained from Inventive Example 11 using the bath containing $ReO_4^-$ in a concentration of 0.0001 mol/L has a composition comprising about 55 atomic % of Re and about 45 atomic % of Cr, and the plated film obtained from Inventive Example 12 using the bath containing $ReO_4^-$ in a concentration of 0.005 mol/L has a composition comprising about 92 atomic % of Re and about 8 atomic % of Cr. Then, the plated film obtained from Inventive Example 9 or 10 using the bath containing $ReO_4^-$ in a concentration of 0.01 mol/L or more (the concentration ratio of $ReO_4^-/Cr^{3+} \geqq 0.1$) has a Re content of 98 atomic % or more.

INVENTIVE EXAMPLE 13

A copper plate was subjected to degreasing/cleaning, and used as a substrate. A solution was prepared to have a $K^+$ ion in a concentration of 0.1 mol/L. In addition to the $K^+$ ion, 0.1 mol/L of $ReO_4^-$, 0.5 mol/L of $Cr^{3+}$, 1.5 mol/L of acetic acid, 0.5 mol/L of ammonium chloride and 0.5 mol/L of potassium bromide were added to the solution to prepare a plating bath. The pH of the plating bath was adjusted at 4 using sulfuric acid and sodium hydrate. Then, an electroplating process was performed under a plating bath temperature of 35° C. and a current density of 100 mA/cm$^2$.

INVENTIVE EXAMPLE 14

Except that the concentration of the $K^+$ ion was set at 2.0 mol/L, an electroplating process was performed under the same conditions as those in Inventive Example 13.

INVENTIVE EXAMPLE 15

Except that the concentration of the $K^+$ ion was set at 0 (zero) mol/L, an electroplating process was performed under the same conditions as those in Inventive Example 13.

Figure 3:
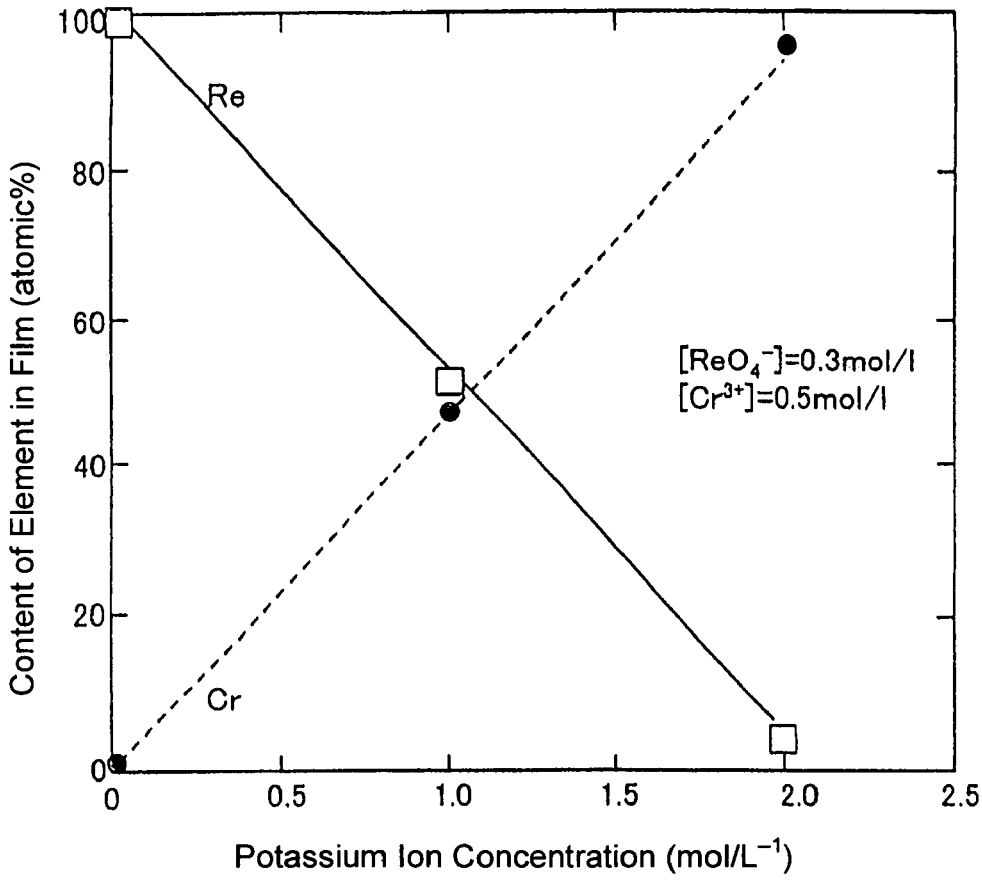
FIG. 3 is a graph showing the relationship between the composition of a plated film and the molar concentration of $K^+$ in a plating bath in each of Inventive Examples 13 to 15.

FIG. 3 shows the relationship between the composition of a plated film and each of the molar concentration of $K^+$ in the plating bath in each of Inventive Examples 13 to 15. As seen in FIG. 3, the content of Re in the plated film is reduced as the concentration of $K^+$ is increased.

INVENTIVE EXAMPLE 16

A copper plate was subjected to degreasing/cleaning, and used as a substrate. A solution was prepared using chromium chloride to have a $Cr^{3+}$ ion in a concentration of 1.0 mol/L. In addition to the $Cr^{3+}$ ion, 0.15 mol/L of perrhenate ion, 0.1 mol/L of $Ni^{2+}$, 1.5 mol/L of β-hydroxybutyric acid and 1.0 mol/L of glycine were added to the solution to prepare a plating bath. The pH of the plating bath was adjusted at 3 using sulfuric acid and sodium hydrate. Then, an electroplating process was performed under a plating bath temperature of 50° C. and a current density of 100 mA/cm$^2$.

INVENTIVE EXAMPLE 17

Except that the concentration of the $Cr^{3+}$ ion was set at 2.0 mol/L, an electroplating process was performed under the same conditions as those in Inventive Example 16.

INVENTIVE EXAMPLE 18

Except that the concentration of the $Cr^{3+}$ ion was set at 3.0 mol/L, an electroplating process was performed under the same conditions as those in Inventive Example 16.

INVENTIVE EXAMPLE 19

Except that the concentration of the $Cr^{3+}$ ion was set at 3.8 mol/L, an electroplating process was performed under the same conditions as those in Inventive Example 16.

COMPARATIVE EXAMPLE 2

Except that the concentration of the $Cr^{3+}$ ion was set at 0.7 mol/L, an electroplating process was performed under the same conditions as those in Inventive Example 16.

Figure 4:
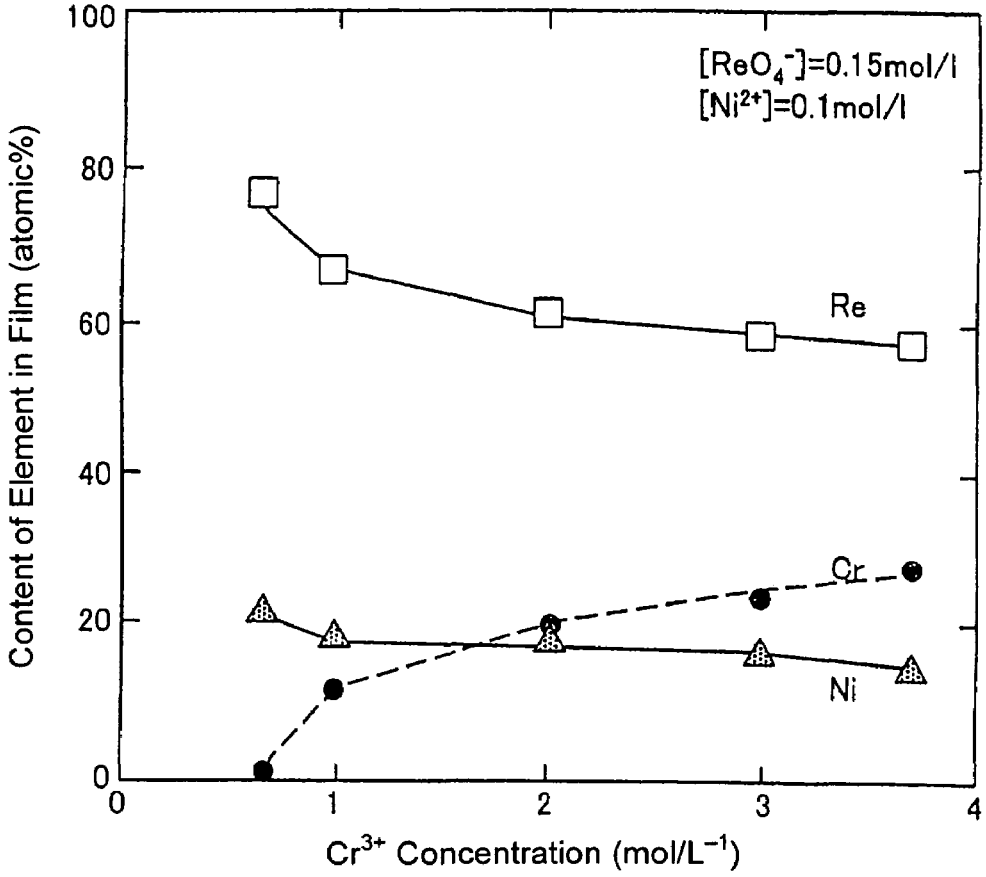
FIG. 4 is a graph showing the relationship between the composition of a plated film and the molar concentration of $Cr^{3+}$ in a plating bath in each of Inventive Examples 16 to 19 and Comparative Example 2.

FIG. 4 shows the relationship between the composition of a plated film and the molar concentration of $Cr^{3+}$ ion in a plating bath in each of Inventive Examples 16 to 19 and Comparative Example 2. As seen in FIG. 4, the plated film obtained from Comparative Example 2 using the bath containing $Cr^{3+}$ in a concentration of 0.7 mol/L has a composition consisting of 89 atomic % of Re and 11 atomic % of Ni. By contrast, the plated film obtained from Inventive Example 16 using the bath containing $Cr^{3+}$ in a concentration of 1.0 mol/L has a composition comprising 65 atomic % of Re, 20 atomic % of Ni and 15 atomic % of Cr. Then, the Cr content in the film is increased as the concentration of $Cr^{3+}$ ion is increased.

INVENTIVE EXAMPLE 20

A solution was prepared to have a $Cr^{3+}$ ion in a concentration of 1.5 mol/L. In addition to the $Cr^{3+}$ ion, 0.15 mol/L of perrhenate ion, 0.1 mol/L of $Ni^{2+}$, 1.0 mol/L of serine and 0.5 mol/L of citric acid were added to the solution to prepare a plating bath. The pH and temperature of the plating bath and a current density were set at the same values as those in Inventive Example 16. After an electroplating process, an alloy film having 60 atomic % of Re, 20 atomic % of Cr and 20 atomic % of Ni was deposited on the surface of an electrode.

INVENTIVE EXAMPLE 21

A solution was prepared to have a $Cr^{3+}$ ion in a concentration of 1.0 mol/L. In addition to the $Cr^{3+}$ ion, 0.15 mol/L of perrhenate ion, 0.1 mol/L of $Ni^{2+}$ and 1.0 mol/L of glycine were added to the solution to prepare a plating bath. The pH and temperature of the plating bath and a current density were set at the same values as those in Inventive Example 16. After an electroplating process, an alloy film having 80 atomic % of Re, 15 atomic % of Cr and 5 atomic % of Ni was deposited on the surface of an electrode.

INDUSTRIAL APPLICABILITY

The present invention allows a Re—Cr alloy or Re-based film usable as a corrosion-resistant alloy coating for a high-temperature component or the like to be formed through an electroplating process using an aqueous solution, so as to provide heat/corrosion resistances to the component, even if it has a complicated shape, in a simplified manner at a low cost.

What is claimed is:

1. A method for forming a Re—Cr alloy film, comprising performing an electroplating process using a plating bath which contains an aqueous solution including:

a perrhenate ion in a concentration of 0.0001 to less than 2.0 mol/L; and a chromium (III) ion in a concentration of greater than 0.001 to 10.0 mol/L, wherein the molar ratio of the perrhenate ion to the chromium (III) ion in said plating bath is in the range of greater than 0.001 to less than 0.1, wherein said plating bath has a pH of 0 to 8, and a temperature of 10 to 80° C.

2. A method for forming a Re—Cr alloy film, comprising performing an electroplating process using a plating bath which contains an aqueous solution including:

a perrhenate ion in a concentration of 0.0001 to less than 2.0 mol/L;

a chromium (III) ion in a concentration of greater than 0.001 to 10.0 mol/L; and at least one ion selected from the group consisting of potassium, rubidium, cesium, calcium, strontium and barium ions, in a concentration of 0.001 to 10.0 mol/L, wherein said plating bath has a pH of 0 to 8, and a temperature of 10 to 80° C.

3. The method as defined in claim 1 or 2, wherein said alloy film to be formed has a composition consisting of Re in the range of greater than zero to less than 98% by atomic composition, and the remainder being Cr except inevitable impurities.

4. A method for forming a Re-based film, comprising performing an electroplating process using a plating bath which contains an aqueous solution including:

a perrhenate ion in a concentration of 0.001 to 2.0 mol/L; and a chromium (III) ion in a concentration of 0.01 to 10.0 mol/L, wherein the molar ratio of the perrhenate ion to the chromium (III) ion in said plating bath is 0.1 or more, wherein said plating bath has a pH of 0 to 8, and a temperature of 10 to 80° C.

5. The method as defined in claim 4, wherein said film to be formed has a composition consisting of greater than 98% or more, by atomic composition, of Re, with the remainder being Cr and inevitable impurities.

6. The method as defined in either one of claims 1, 2, 4, and 5, wherein said plating bath contains an organic acid in a concentration of 0.1 to 15.0 equivalents to the concentration of all of said metal ions.

7. A method for forming a Re—Cr—Ni alloy film, comprising performing an electroplating process using a plating bath which contains an aqueous solution including:

a perrhenate ion in a concentration of 0.01 to 2.0 mol/L;

a chromium (III) ion in a concentration of greater than 0.8 to 4.0 mol/L; and a nickel (II) ion in a concentration of 0.0001 to 0.2 mol/L, wherein said plating bath has a pH of 0 to 8, and a temperature of 10 to 80° C.

8. The method as defined in claim 7, wherein the molar ratio of the chromium (III) ion to the nickel (II) ion in said plating bath is 2 or more.

9. The method as defined in claim 7 or 8, wherein said film to be formed has a composition consisting of Re in the range of 50 to less than 98% by atomic composition, Cr in range of 2 to less than 45% by atomic composition, and the remainder being Ni except inevitable impurities.

10. The method as defined in claim 7 or 8, wherein said plating bath contains an organic acid and/or a boric acid, in a concentration of 0.1 to 5.0 equivalents to the concentration of all of said metal ions.

11. The method as defined in either one of claims 1, 2, 4, 5, 7, and 8, wherein said plating bath contains an ammonium ion in a concentration of 0.0001 to 5.0 mol/L, and/or a boric acid in a concentration of 0.0001 to 5.0 mol/L.

12. The method as defined in either one of claims 1, 2, 4, 5, 7 and 8, wherein said plating bath contains a bromine ion in a concentration of 0.0001 to 5.0 mol/L.

13. The method as defined in either one of claims 1, 2, 4, 5, 7, 8, wherein said plating bath contains one or more ions selected from a group consisting of sulfate ion, chloride ion, lithium ion, sodium ion and potassium ion, respectively in a concentration of 0.0001 to 5.0 mol/L.

14. The method as defined in either one of claims 1, 2, 4, 5, 7 and 8, wherein said plating bath contains a sulfate ion in a concentration of 0.0001 to 5.0 mol/L, a chloride ion in a concentration of 0.0001 to 5.0 mol/L, a lithium ion in a concentration of 0.0001 to 5.0 mol/L, a sodium ion in a concentration of 0.0001 to 5.0 mol/L, and/or a potassium ion in a concentration of 0.0001 to 5.0 mol/L.

* * * * *